US012259183B2

(12) United States Patent
Dziedzic

(10) Patent No.: US 12,259,183 B2
(45) Date of Patent: Mar. 25, 2025

(54) METHODS AND APPARATUS FOR BAG WITH COOLING ELEMENT

(71) Applicant: Bags for Swag, LLC, Scottsdale, AZ (US)

(72) Inventor: Heather Dziedzic, Scottsdale, AZ (US)

(73) Assignee: Bags for Swag, LLC, Scottsdale, AZ (US)

( * ) Notice: Subject to any disclaimer, the term of this patent is extended or adjusted under 35 U.S.C. 154(b) by 195 days.

(21) Appl. No.: 18/177,330

(22) Filed: Mar. 2, 2023

(65) Prior Publication Data

US 2023/0280077 A1 Sep. 7, 2023

Related U.S. Application Data

(60) Provisional application No. 63/316,502, filed on Mar. 4, 2022.

(51) Int. Cl.

| | |
|---|---|
| ***F25D 3/08*** | (2006.01) |
| ***A45C 13/02*** | (2006.01) |
| ***A45C 13/10*** | (2006.01) |

(52) U.S. Cl.

CPC ..... *F25D 3/08* (2013.01); *A45C 13/02* (2013.01); *A45C 13/103* (2013.01); *F25D 2201/128* (2013.01); *F25D 2303/0821* (2013.01); *F25D 2331/8012* (2013.01)

(58) Field of Classification Search

CPC ... F25D 3/08; A45C 11/20; B32B 5/04; B32B 2250/04

See application file for complete search history.

(56) References Cited

U.S. PATENT DOCUMENTS

| | | | | |
|---|---|---|---|---|
| 5,865,314 A * | 2/1999 | Jacober | A61J 1/165 62/457.2 |
| 6,253,570 B1 * | 7/2001 | Lustig | F25D 3/08 62/457.2 |
| 6,935,133 B2 * | 8/2005 | Keeter | A61M 5/003 62/457.2 |
| 9,943,150 B2 * | 4/2018 | Morrow | A45C 13/02 |
| 2013/0233741 A1 * | 9/2013 | Caruth | A61J 7/0084 206/232 |

* cited by examiner

*Primary Examiner* — Lionel Nouketcha

(74) *Attorney, Agent, or Firm* — Noblitt & Newson, PLLC

(57) ABSTRACT

A cooling bag according to various aspects of the present technology comprises a main body configured to form an interior receiving section. The main body may comprise front and rear panels and a bottom panel extending between the front and rear panels. At least one of the front, rear or bottom panels comprises a multi-layer structure comprising an external fabric layer; an interior liner; and a plurality of intermediate insulating layers disposed between the external fabric layer and the interior liner. The multi-layer structure may further comprise at least one air gap disposed between at least one intermediate insulating layer. A cooling sleeve may be disposed within the interior receiving section. The cooling sleeve may divide the interior receiving section into a front receiving section and a back receiving section. The cooling sleeve may be configured to receive a cooling element.

19 Claims, 4 Drawing Sheets

METHODS AND APPARATUS FOR BAG WITH COOLING ELEMENT

CROSS-REFERENCES TO RELATED APPLICATIONS

This application claims the benefit of U.S. Provisional Patent Application No. 63/316,502, filed on Mar. 4, 2022, and incorporates the disclosure of this application by reference.

BACKGROUND OF THE TECHNOLOGY

Human use of bags extends beyond memory, tradition or recorded history. Throughout recorded history, bags have been used for many purposes. Like painting or poetry, bags may be used as a form of expression or assertion of a user's personality, feelings or ideas, demonstrating the uniqueness of a user. Bags may simultaneously be used as a fashion item and to provide a functional way of storing personal effects.

While various cooling bags have been proposed in the prior art, much of the prior art focuses solely on functionality. A need exists for an innovative fashionable and functional cosmetic cooling bag with an insulating interior for keeping cosmetics, skin care products, toiletries and other items from melting, or otherwise becoming comprised due to environmental conditions such as heat. It may also be preferable to some people that certain types of personal items generally be kept at a cooler temperature than that of the ambient environment for ease of use.

SUMMARY OF THE TECHNOLOGY

A cosmetic cooling bag according to various aspects of the present technology comprises a main body configured to form an interior receiving section. The main body may comprise front and rear panels and a bottom panel extending between the front and rear panels. At least one of the front, rear or bottom panels comprises a multi-layer structure comprising an external fabric layer; an interior liner; and a plurality of intermediate insulating layers disposed between the external fabric layer and the interior liner. The multi-layer structure may further comprise at least one air gap disposed between at least one intermediate insulating layer. A cooling sleeve may be disposed within the interior receiving section. The cooling sleeve may divide the interior receiving section into a front receiving section and a back receiving section. The cooling sleeve may be configured to receive a cooling element.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, connectors, and geometries, which may carry out a variety of operations. In addition, the technology described is merely one exemplary application for the disclosed device.

Methods and apparatus for a cooling bag according to various aspects of the present technology may operate in conjunction any material such as: leather, vinyl, suede, cloth, aluminum foil, neoprene, plastic, cotton, or other natural or synthetic materials. Various representative implementations of the present technology may be applied to any type of portable bag, pouch, carrying case, purse, duffel or suitcase.

Figure 1:
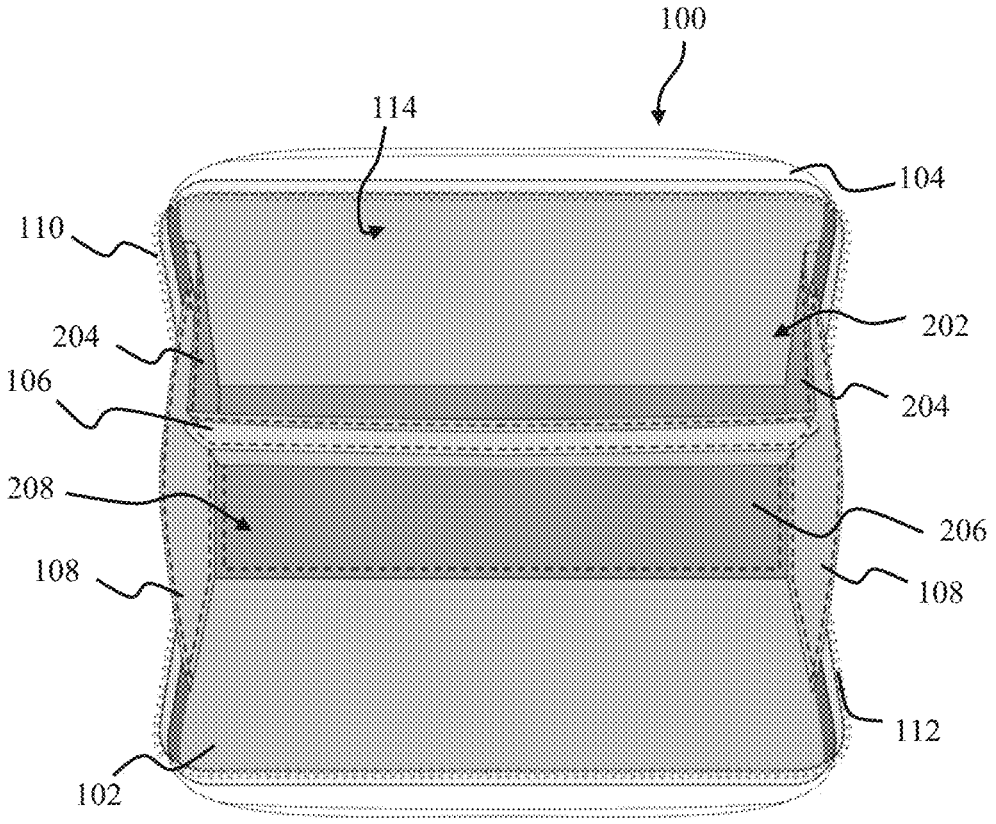
FIG. 1 representatively illustrates a cooling bag having a main body receiving section in accordance with an exemplary embodiment of the present technology.
Figure 2A:
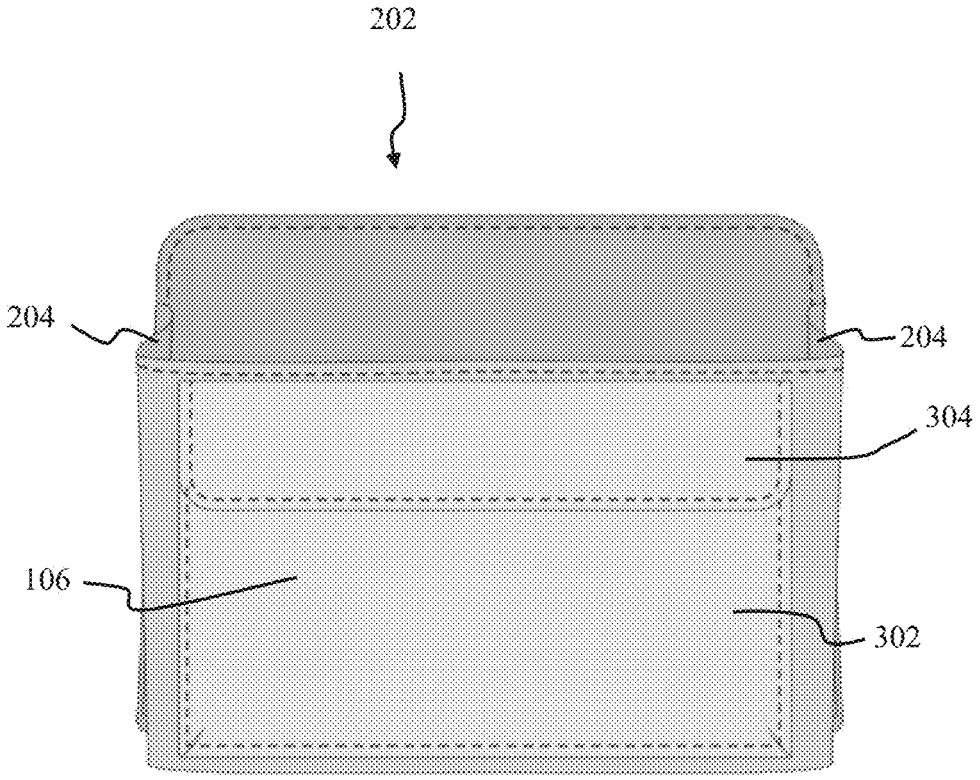
FIG. 2A representatively illustrates an expandable first pocket with a cooling sleeve closure element in a closed position in accordance with an exemplary embodiment of the present technology.
Figure 2B:
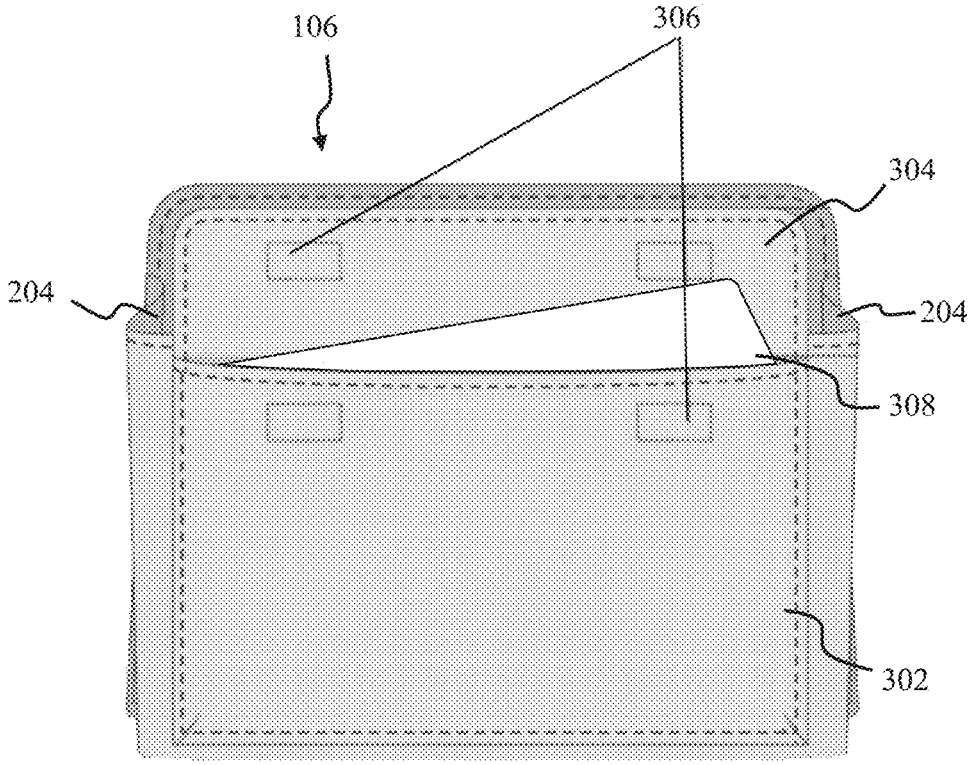
FIG. 2B representatively illustrates a cooling sleeve with the closure element in an open position in an open position in accordance with an exemplary embodiment of the present technology.

Referring to FIGS. 1-2B, in one embodiment, the cooling bag 100 may generally comprise a main body having a front panel 102, a rear panel 104 and a bottom panel 206 extending between the front and rear panels 102, 104, as is commonly found with bags known in the art. In some embodiments, the main body may comprise two outer gussets 108 connected between the front and back panels 102, 104. A fastening device 110, 112 may extend along the outer peripheral edges of the front and back panels 102, 104. The fastening device 110, 112 may be configured to connect the outer peripheral edges of the front and rear panels 102, 104 together to form an interior receiving section 114.

A cooling sleeve 106 may be disposed within the interior receiving section 114. The cooling sleeve may be configured to receive a cooling element 308 such as a freezable pack. The cooling sleeve 106 may divide the interior receiving section 114 into a front receiving section 208 and a back receiving section 202. In various embodiments, the front receiving section 208 is proximate to the front panel 102 and the back receiving section 202 is proximate to the back panel 104.

The interior receiving section 114 may comprise a plurality of pockets or recesses. For example, in one embodiment, the back receiving section 202 of the interior receiving section 114 may comprise an expandable first pocket connected to an interior surface of the back panel 104 via a pair of inner gussets 204. A remaining volume within the interior receiving section 114 may form the front receiving section 208. The cooling sleeve 106 may be attached to a surface of the back receiving section 202 and contain a recess for receiving the cooling element 308 in the interior of the cooling bag 100. The cooling sleeve 106 may comprise any suitable shape or size or be positioned along any suitable portion of the back receiving section 202.

Referring to FIGS. 2A-B, in one embodiment, the cooling sleeve 106 may comprise a main body 302 and a closure element 304. The main body 302 may comprise a front and back wall joined at peripheral edges to create an inner volume for receiving the cooling element 308 such as a freezable pack or block. The cooling sleeve 106 may comprise any shape, thickness, size and combination of materials. The cooling sleeve 106 may be configured of any suitable material or combination of materials to hold the cooling element 308 in place and absorb heat within the interior receiving section 114. For example, in one embodiment, the cooling sleeve 106 is comprised of a polyliner fabric material matching other interior fabrics of the cooling bag 100.

The closure element 304 is configured to securely hold the cooling element 308 in position during use. In one embodiment, the closure element 304 may create an airtight and watertight seal for the inner volume of the cooling sleeve 106. The closure element 304 may comprise any suitable closure element such as: a plurality of magnets, a zipper, a mating tongue and groove, or a surface having a reusable adhesive material.

Figure 3:
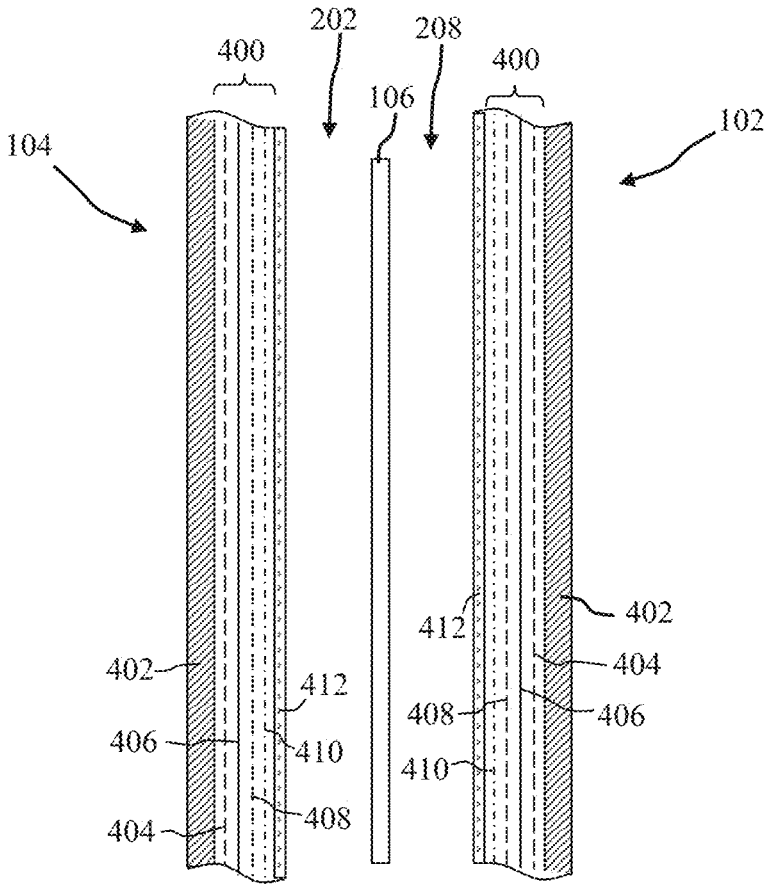
FIG. 3 representatively illustrates a cross-sectional view of a multi-layer structure in accordance with an exemplary embodiment of the present technology.
Figure 4:
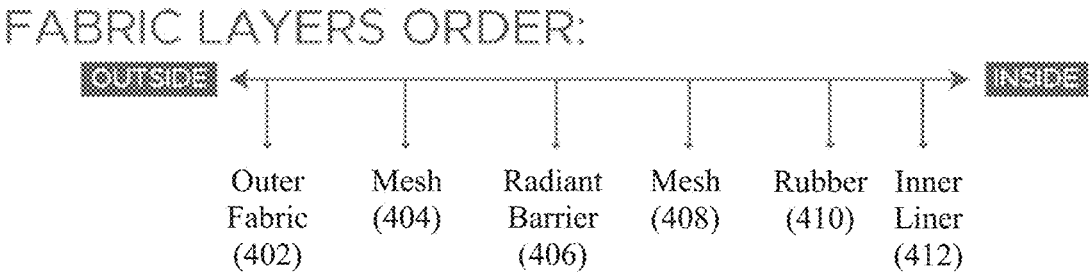
FIG. 4 representatively illustrates a multi-layer structure order in accordance with an exemplary embodiment of the present technology.

Referring to FIGS. 3 and 4, in one representative embodiment, at least one of the front panel 102, the rear panel 104 and/or the back panel may comprise a multi-layer structure configured to thermally insulate the interior receiving section 114 against heat transfer from the ambient environment. The multi-layer structure may comprise multiple layers of any suitable thickness, size, shape or combination of materials configured to thermally insulate the interior receiving section 114 against heat transfer from the ambient environment on the exterior of the cooling bag 100.

In one embodiment, the multi-layer structure may comprise an external fabric layer 402; an interior liner 412; and a plurality of intermediate insulating layers 400 disposed between the external fabric layer 402 and the interior liner 412. For example, the multi-layer structure may comprise: a first mesh material 404 disposed adjacent to an inner facing (towards the interior receiving section 114) surface of the external fabric layer 402. A radiant barrier 406 may be disposed between an inner facing surface of the first mesh material 404 and outwardly facing (away from the interior section 114) surface of a second mesh material 408. A rubber layer 410 may be disposed between an inner facing surface of the second mesh material 408 and an outwardly facing surface of the interior liner 412. The multi-layer structure 400 may further comprise an air gap disposed between at least one intermediate insulating layer to increase resistance to heat transfer and better thermally insulate the interior receiving section 114 against from the ambient environment. For example, the first and second layers of mesh material 404, 408 may create an interstitial air gap between the radiant barrier 406 and the external fabric layer 402 and between the radiant barrier 406 and the rubber layer 410.

In one embodiment, and referring now to FIG. 4, the order of the layers making up at least one of the front panel 102, the rear panel 104 and the bottom panel 208 may be arranged in the following order, from outside to inside: outer fabric (402), mesh material (404), radiant barrier (406), mesh material (408), rubber (410) and inner liner (412).

Figure 5:
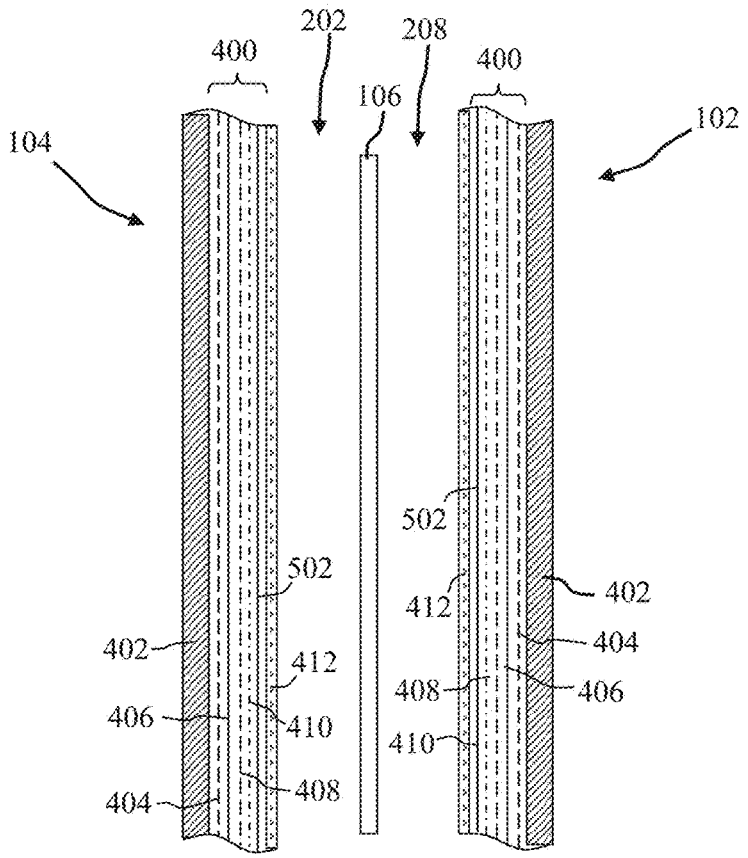
FIG. 5 representatively illustrates a cross-sectional view of an alternative embodiment of the multi-layer structure in accordance with the present technology.
Figure 6:
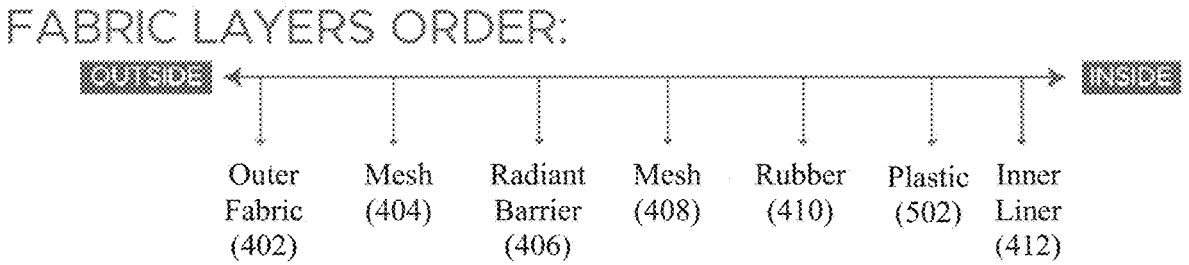
FIG. 6 representatively illustrates an alternative embodiment of the multi-layer structure order in accordance with the present technology.

Referring to FIGS. 5 and 6, in an alternative embodiment, the multi-layer structure may further comprise a structural element configured to provide some rigidity to the front and rear panels 102, 104. For example, the multi-layer structure may comprise a plastic layer 502 disposed between the rubber layer and the outwardly facing surface of the interior liner 412. More specifically, the order of the layers making up the front panel and rear panels 102, 104 may be arranged in the following order, from outside to inside: outer fabric (402), mesh material (404), radiant barrier (406), mesh material (408), rubber (410), plastic (502), and inner liner (412).

The layers may comprise any suitable material for insulating the interior receiving section 114 from the exterior environment. For example, the mesh material 404, 408 may comprise any suitable material adapted to create interstitial air pockets, or gaps, between the layers of the multi-layer structure. In various embodiments, the mesh material 404, 408 may comprise at least one layer of a fabric such as tulle, netting, or lace. The material may comprise of any suitable thread count, texture, netting pattern, fiber thickness, fiber denier, and/or mass density. The fiber may comprise any suitable fiber, for example, rayon, nylon, polyester, silk and the like.

The radiant barrier 406 may comprise any suitable material for reflecting heat away from the interior receiving section 114 to thermally insulate the interior receiving section 114 against heat transfer from the ambient environment. For example, the radiant barrier 406 may comprise any reflective material capable of reflecting a radiant heat source rather than absorbing it. In various embodiments, the radiant barrier 406 may comprise a foil layer such as a thin sheet of aluminum foil of between about two thousandths and about six thousandths of an inch in thickness (0.05-0.15 mm). In some embodiments, the radiant barrier 406 may comprise a sheet having a reflective surface. The radiant barrier 406 may be configured with the reflective surface disposed adjacent to an inner surface of the first mesh material 404 to face the external fabric layer 402.

In various embodiments, the at least one rubber layer 410 may comprise any suitable rubber to thermally insulate the interior receiving section against heat transfer from the ambient environment. For example, the rubber layer 410 may comprise a neoprene. In some embodiments, the rubber layer 410 may comprise multiple thin layers of neoprene with at least one layer of mesh material disposed between each thin layer of neoprene. The total thickness of the rubber layer 410 may comprise any suitable thickness for providing insulating properties. For example, the total thickness of the rubber layer 410 may comprise approximately one-eighth of an inch (3.2 mm).

The plastic layer 502 may comprise any suitable plastic for providing structural integrity to the multi-layer structure. For example, the plastic layer [#] may comprise high-density polyethylene (HDPE), polyvinyl chloride (PVC), Polyethylene Terephthalate (PET), polycarbonate, polyctide, acrylic, acrylonitrile butadiene, styrene, fiberglass, and/or nylon.

The cooling bag 100 may comprise any suitable size or shape depending on the desired application and use. For example, in one embodiment, the cooling bag 100 may be about 6-9 inches (15.3-22.9 cm) in width by 5-7 inches (12.7-17.8 cm) in height by 2-3.5 inches (5.1-8.9 cm) in thickness. The two outer gussets 108 may be about 3 inches wide. The back receiving section 202 may comprise a width of about ¾ inches (1.9 cm).

The cooling sleeve 106 may be located in any suitable section of the cooling bag 100. In some embodiments, multiple cooling sleeves 106 may be dispersed throughout the cooling bag 100. For example, a cooling sleeve 106 may be incorporated along an inner facing surface of each of the front and back panels 102, 104.

The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the technology has been described with reference to specific exemplary embodiments. Various modifications and changes may be made, however, without departing from the scope of the present technology as set forth in the claims. The specification and figures are illustrative, rather than restrictive, and modifications are intended to be included within the scope of the present technology. Accordingly, the scope of the technology should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims. Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise," "comprises," "comprising," "having," "including," "includes," or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same. Any terms of degree such as "substantially," "about," and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

The invention claimed is:

1. A cooling bag, comprising:

a main body comprising:

a front panel;

a rear panel; and a bottom panel extending between the front and rear panels, wherein each of the front and rear panels comprises a multi-layer structure comprising:

an external fabric layer;

an interior liner; and a plurality of intermediate insulating layers disposed between the external fabric layer and the interior liner, wherein the plurality of intermediate insulating layers comprises:

a first mesh material disposed adjacent to an inner surface of the external fabric layer;

a radiant barrier disposed adjacent to an inner facing surface of the first mesh material;

a second mesh material disposed adjacent to an inner facing surface of the radiant barrier;

at least one rubber layer disposed adjacent to an inner facing surface of the second mesh material; and a plastic layer disposed between an inner facing surface of the rubber layer and an outwardly facing surface of the interior liner;

a fastening device extending along outer peripheral edges of the front and rear panels, wherein the fastening device is configured to connect the outer peripheral edges of the front and rear panels together to form an interior receiving section; and a cooling sleeve disposed within the interior receiving section and dividing the interior receiving section into a front receiving section and a back receiving section, wherein the front receiving section is proximate to the front panel and the back receiving section is proximate to the rear panel.

2. The cooling bag according to claim 1, wherein the fastening device comprises a zipper.

3. The cooling bag according to claim 1, wherein the interior receiving section comprises at least one expandable pocket.

4. The cooling bag according to claim 1, wherein the interior receiving section comprises an expandable pocket connected to an interior surface of the back panel via a pair of inner gussets.

5. The cooling bag according to claim 1, further comprising an air gap disposed between at least two intermediate insulating layers.

6. The cooling bag according to claim 1, wherein the at least one rubber layer comprises alternating multiple layers of mesh material disposed between alternating multiple rubber layers.

7. The cooling bag according to claim 1, wherein each of the mesh material comprises at least one layer of material adapted to create interstitial air pockets between the adjacent layers of the multi-layer structure.

8. The cooling bag according to claim 1, wherein the rubber layer comprises neoprene.

9. The cooling bag according to claim 1, wherein the radiant barrier comprises a foil layer.

10. The cooling bag according to claim 1, wherein the cooling sleeve is configured to receive a cooling element.

11. The cooling bag according to claim 10, wherein the cooling element comprises a freezable pack.

12. The cooling bag according to claim 1, wherein the bottom panel comprises:

an external fabric layer;

an interior liner; and a plurality of intermediate insulating layers disposed between the external fabric layer and the interior liner.

13. The cooling bag of claim 1, wherein the cooling sleeve further comprises a closure element.

14. The cooling bag of claim 13, wherein the closure element comprises one of: a magnet, a zipper, a snap, a mating tongue and groove or reusable adhesive material.

15. A cooling bag, comprising:

a main body configured to form an interior receiving section, wherein the main body comprises a multi-layer structure comprising:

an external fabric layer;

an interior liner; and a plurality of intermediate insulating layers disposed between the external fabric layer and the interior liner, wherein the plurality of intermediate insulating layers comprises:

a first mesh material disposed adjacent to an inner facing surface of the external fabric layer;

a radiant barrier disposed adjacent to an inner facing surface of the first mesh material;

a second mesh material disposed adjacent to an inner facing surface of the radiant barrier;

at least one rubber layer disposed adjacent to an inner facing surface of the second mesh material; and a plastic layer disposed between an inner surface of the rubber layer and an outwardly facing surface of the interior liner; and a cooling sleeve disposed within the interior receiving section and dividing the interior receiving section into a plurality of receiving sections, wherein the cooling sleeve is configured to receive a cooling element.

16. The cooling bag according to claim 15, wherein the cooling sleeve divides the interior receiving section into a front receiving section and a back receiving section, wherein the front receiving section is proximate to a front panel of the main body and the back receiving section is proximate to a back panel of the main body.

17. The cooling bag according to claim 15, wherein the cooling sleeve comprises:

a pocket for receiving the cooling element; and a closure element to hold the cooling element within the pocket.

18. The cooling bag according to claim 15, wherein the multi-layer structure further comprises an air gap disposed between at least two intermediate insulating layers.

19. The cooling bag according to claim 15, wherein each of the first and second mesh material comprises at least one layer of material adapted to create interstitial air pockets between the layers of the multi-layer structure.

* * * * *